United States Patent [19]

Schiel

[11] 4,073,679

[45] Feb. 14, 1978

[54] CYLINDER FOR FORMING, GUIDING AND/OR TRANSPORTING PAPER WEBS OR THE LIKE

[75] Inventor: Christian Schiel, Heidenheim, Germany

[73] Assignee: J. M. Voith GmbH, Heidenheim, Germany

[21] Appl. No.: 743,301

[22] Filed: Nov. 19, 1976

[30] Foreign Application Priority Data

Nov. 22, 1975 Germany ..... 2552485

[51] Int. Cl.[2] ..... D21F 1/46; D21F 1/60; D21F 3/10

[52] U.S. Cl. ..... 162/306; 29/116 AD; 29/121.3; 162/314; 162/357; 162/369; 162/372; 162/DIG. 7

[58] Field of Search ..... 162/306, 314, 351, 357, 162/368, 369, 372, 373, DIG. 7, 358, 276, 299, 301, 304; 29/115, 116 AD, 121.2, 121.3

[56] References Cited

U.S. PATENT DOCUMENTS

| | | | |
|---|---|---|---|
| 1,714,238 | 5/1929 | Pope | 162/306 |
| 1,770,834 | 7/1930 | Bergeron | 162/314 |
| 1,949,998 | 3/1934 | French | 162/357 X |
| 2,718,825 | 9/1955 | Goodwillie | 162/306 |
| 3,207,658 | 9/1965 | Lamb | 162/306 |
| 3,579,422 | 5/1971 | Minick et al. | 162/357 X |
| 3,853,698 | 12/1974 | Mohr | 162/358 |

FOREIGN PATENT DOCUMENTS

| | | |
|---|---|---|
| 1,461,066 | 12/1968 | Germany. |
| 1,561,674 | 4/1970 | Germany. |

*Primary Examiner*—Richard V. Fisher
*Attorney, Agent, or Firm*—Peter K. Kontler

[57] ABSTRACT

The web forming, guiding and/or transferring cylinder in the wire section of a papermaking machine has a deformable foraminous shell which is made of filamentary material and the end portions of which are clamped to rigid rotary ring-shaped end walls. The cylinder surrounds a rigid stationary back support which engages the internal surface of the shell opposite that portion of the external surface of the shell which contacts the web. The back support has grooves and/or ports which convey expelled liquid from the web into a suction chamber for admission into the saveall of the papermaking machine. One of the end walls is movable axially to change the axial tensional stress upon the shell. The back support has a convex external surface whose center of curvature may but need not be located on the axis of the cylinder.

18 Claims, 6 Drawing Figures

Fig. 3
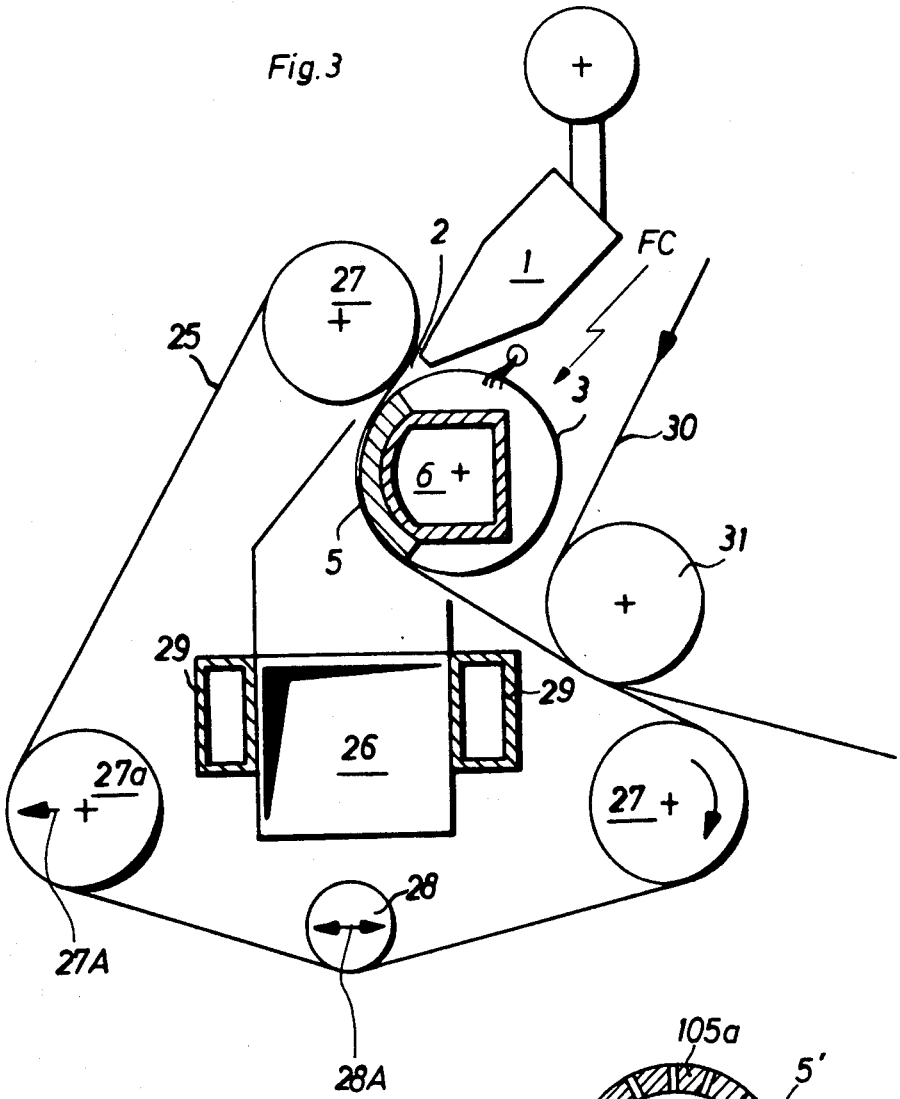
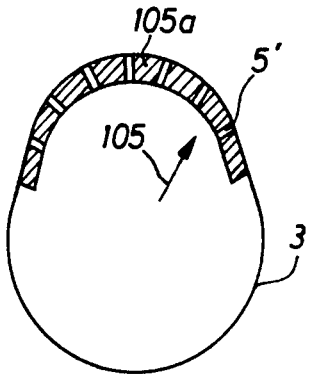
Fig. 6

CYLINDER FOR FORMING, GUIDING AND/OR TRANSPORTING PAPER WEBS OR THE LIKE

BACKGROUND OF THE INVENTION

The present invention relates to machines for forming and/or processing webs of fibrous material, especially to papermaking machines. More particularly, the invention relates to improvements in rotary cylinders which can be utilized in such machines for conversion of a suspension of fibers into a paper or cardboard web, for guidance of the web and/or for transport of the web to further processing stations. Still more particularly, the invention relates to improvements in rotary cylinders which can be used with advantage in wire sections of papermaking or like machines.

A papermaking machine utilizes a host of rotary components, such as cylinders or rollers having uninterrupted peripheral surfaces, cylinders or rollers whose shells are foraminous (these include so-called egoutteurs or dandy rollers, sieves and others) and which serve for evacuation or expulsion of liquid from paper furnish or from a wet paper or cardboard web, several guide rolls, tensioning rolls and regulating rolls, as well as one or more wires, felts and/or nonpermeable sheets and foils.

Liquid-permeable felts, sieves and analogous components play a very important role in the manufacture of paper or cardboard webs because they allow for efficient expulsion of liquid from the paper furnish and/or moist web, either by gravity, by the application of mechanical pressure and/or by establishing a pressure differential between the opposite sides of the liquid-permeable components. Moreover, the application of higher pressure to one side and/or the application of lower pressure to the other side of a web renders it possible to conveniently transfer the web from a first component onto a second component or vice versa. For example, a rotary forming cylinder can attract the filaments of paper furnish as they issue from the slice of a head box or to attract a web which is transported by a wire or felt. Inversely, a cylinder wherein the pressure exceeds atmospheric pressure can be used to effect the transfer of a web from the periphery of the cylinder onto a wire or felt. A further important advantage of foraminous cylinders is that the force with which a wet web of artificial and/or natural fibers adheres thereto is much less pronounced than the adhesion of such web to a cylinder having an uninterrupted (non-permeable) peripheral surface. This facilitates the transfer of webs from foraminous cylinders to further transporting means which convey the web to successive processing stations.

All presently known foraminous cylinders for the formation, guidance and/or transport of paper webs or the like exhibit a number of serious drawbacks. For example, the shell of an egoutteur or a sieve must be supported from within by a complex, bulky and highly expensive core which is machined with a view to allow for evacuation of liquid therethrough. Since the core is heavy and bulky, it is likely to run out of round, to bend, to vibrate and/or to produce other undesirable effects. Furthermore, and since the core must exhibit a substantial strength, it cannot be designed to permit for practically unobstructed flow of that liquid which is free to pass through the permeable shell of the cylinder; therefore, the surplus of liquid (i.e., that quantity of liquid which is free to pass through the shell but is intercepted by the core) is likely to be sprayed onto the web and to adversely affect the appearance and/or other characteristics of the finished product. Still further, foreign matter which accumulates between the ribs of the core and the shell is likely to contaminate the shell and hence the web; such contaminants also affect the appearance and/or other qualities of the ultimate product.

The cleaning of cores in such cylinders is a difficult procedure, mainly because the cores cannot be cleaned from within, e.g., by jets of water or another cleaning fluid. Therefore, the cleaning of egoutteurs and analogous foraminous cylindrical components during operation of a papermaking machine is a problem which still awaits a satisfactory solution. Such components are cleaned periodically when the machine is at a standstill. This results in significant reduction of the output of the machine.

The cleaning of foraminous components in the form of elongated endless wires or felts is somewhat simpler, i.e., such components can be cleaned by directing jets of cleaning fluid against the internal surface of the wire or felt. However, the outlay for the cleaning equipment and the space requirements of such equipment are very high. As a rule, the wire or felt must be trained over several (at least three or four) rotary elements in the form of guide rolls, tensioning rolls, regulating rolls and others. The rolls must be mounted in a heavy and bulky frame, and the sieve or felt must be mounted for movement to and from the operative position.

OBJECTS AND SUMMARY OF THE INVENTION

An object of the invention is to provide a papermaking or like machine with novel and improved rotary web guiding, forming and/or transporting means which is simpler, lighter, less expensive, more efficient, more versatile and more compact than heretofore known means which serve the same or similar purpose.

Another object of the invention is to provide a novel and improved rotary cylinder, preferably a cylinder whose shell is foraminous, which can be used as a simpler, less expensive and superior substitute for presently known forming cylinders, egoutteurs, rotary pressing sieves and analogous components of papermaking or like machines wherein a web consisting of or including fibrous material is transported past a plurality of processing stations.

A further object of the invention is to provide a cylinder which can be cleaned in a simple and time-saving manner, which can be installed in existing machines as a superior substitute for existing egoutteurs, forming cylinders or the like, and which can be used with advantage in practically all types of papermaking or like machines irrespective of the width of the web which is formed and processed in such machines.

An ancillary object of the invention is to provide the cylinder with a novel and improved shell and with novel and improved means for supporting, tensioning, driving and/or profiling the shell.

The invention is embodied in a machine for forming, guiding and/or transporting elongated webs of fibrous material which move along a predetermined path, particularly in the wire section of a papermaking machine. The machine comprises a hollow cylinder including a deformable tubular shell which is adjacent to one side of and extends transversely of the path for the web so that a portion of the external surface of the shell contacts the web. The cylinder further comprises two rotary end walls which are clamped or otherwise secured to the respective end portions of the shell and at least one of which can be driven by a belt transmission or the like. The machine further comprises a rigid back support which is installed in the interior of the cylinder and engages the internal surface of the shell opposite the web-contacting portion of the external surface. Thus, the back support insures that the configuration or profile of the web-contacting portion of the shell invariably follows the outline of the respective surface of the back support. The latter may be provided with grooves, recesses, ports and/or otherwise configurated passages for the evacuation of liquid which passes through the deformable shell, provided that the shell is permeable to liquids and/or that the back support should permit for evacuation of liquid. The shell may be made of intersecting filaments one group of which extends axially of the cylinder and the other group of which extends circumferentially of the cylinder. The filaments of the two groups may be bonded to and/or interwoven with each other.

The novel features which are considered as characteristic of the invention are set forth in particular in the appended claims. The improved cylinder itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 3 is a schematic partly side elevational and partly longitudinal vertical sectional view of a modified papermaking machine with a single forming cylinder;

FIG. 6 is a schematic transverse sectional view of a cylinder which constitutes a modification of the cylinders shown in FIGS. 1 to 5.

DESCRIPTION OF THE PREFERRED EMBODIMENTS

Figure 1:
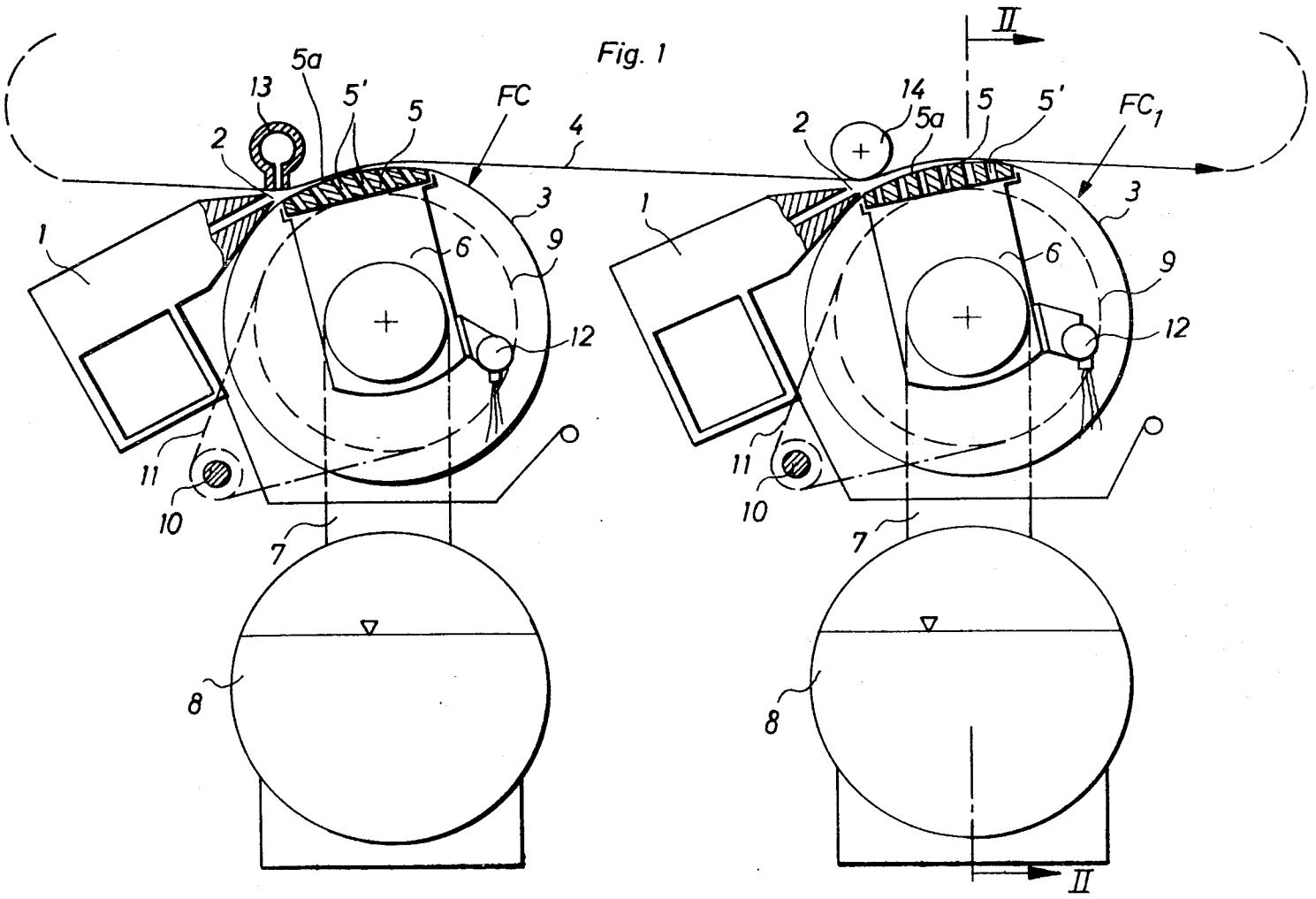
FIG. 1 is a schematic partly elevational and partly longitudinal vertical sectional view of a papermaking machine with two forming cylinders each of which embodies one form of the invention.

Referring first to FIG. 1, there is shown a portion of a papermaking machine including an endless felt 4 having a lower reach which travels past two forming cylinders FC and $FC_1$ each of which is constructed, assembled, mounted and driven in accordance with a feature of the invention. Each forming cylinder comprises a hollow cylindrical deformable portion 3 which resembles a piece of hose and is permeable to liquids. For example, each cylindrical portion 3 (hereinafter called shell for short) may consist of interlaced and/or intersecting filaments 3A and 3B which respectively extend in the axial and circumferential direction of the respective forming cylinder. The shell 3 of each forming cylinder surrounds a stationary rigid guide or back support 5 having a convex outer surface **5*a* which engages the adjacent portion of internal surface of the respective shell 3 so as to prevent uncontrolled flexing or to induce a desired flexing of the shell in that region where the shell is engaged by the lower reach of the felt 4 or by a paper web. The back supports 5 have passages in the form of ports or apertures 5' which extend inwardly from the respective convex surfaces 5*a* and serve to convey liquid into a stationary receptacle 6** (e.g., a suction chamber) in the interior of the respective forming cylinder.

The nip of the lower reach of the felt 4 and each of the shells 3 receives a narrow but wide stream of paper furnish from the slice 2 of a discrete head box 1. The slices 2, as well as the back supports 5, extend transversely of the direction of movement of the felt 4 (i.e., at right angles to the plane of FIG. 1). The back supports 5 may but need not extend along the full length of the respective shells 3 (see FIG. 2), and each of these back supports can be said to constitute a component part (i.e., the foraminous top wall or cover) of the respective receptacle 6. Liquid which is expelled from the paper furnish supplied by the respective slices 2 enters the ports 5' of the back supports 5 partly by gravity, partly in response to mechanical pressure of the lower reach of the felt 4, and partly in response to suction (if any) in the respective receptacles 6. The receptacles 6 admit the removed liquid into pairs of laterally extending return pipes 7 (see FIG. 2) which discharge the liquid into two savealls 8, one for each forming cylinder. Such liquid is evacuated from the savealls 8 by suitable pumps, mixed with fibers to form a fresh paper furnish, and readmitted into the respective head boxes 1.

The end portions of each shell 3 are secured to two coaxial ring-shaped rigid end walls 9 which subject the respective shell to axial stresses and cause the shell to rotate in a clockwise direction, as viewed in FIG. 1. The means for rotating the shells 3 through the medium of the respective pairs of end walls 9 comprises endless flat or toothed belts 11 which are driven by intermediate shafts 10 receiving torque from suitable prime mover means, not shown.

Each forming cylinder further contains at least one cleaning device 12 which discharges streams of water or another cleaning liquid against successive increments of the internal surface of the respective shell 3 to clean the interstices of the shell before they return into the range of the respective slice 2. The web or sheet of fibrous material which remains at the underside of the felt 4 is transported to a further processing station, not shown, which is located to the right of the forming cylinder $FC_1$, as viewed in FIG. 1. Such further processing station may accommodate a battery of presses which effect the expulsion of additional liquid from the web.

The lower reach of the felt 4 is caused to overlie that portion of the external surface of the left-hand shell 3 which overlies the convex surface **5*a* of the respective back support 5 under the action of a downwardly extending shoe forming part of a stationary suction pipe 13. A rotating roller 14 is used to urge the felt 4 against the right-hand shell 3 of FIG. 1 in the region of the convex surface 5*a* of the right-hand back support 5. It is clear that the structure shown in FIG. 1 may include two suction pipes 13, one for each forming cylinder, two rollers 14, or other suitable means for maintaining the felt 4 in requisite contact with the external surfaces of shells 3 in regions above the corresponding back supports 5. The felt 4** is trained over several guide rollers (not shown) so that it travels along an endless path a portion of which extends directly above the forming cylinders FC and $FC_1$.

Figure 2:
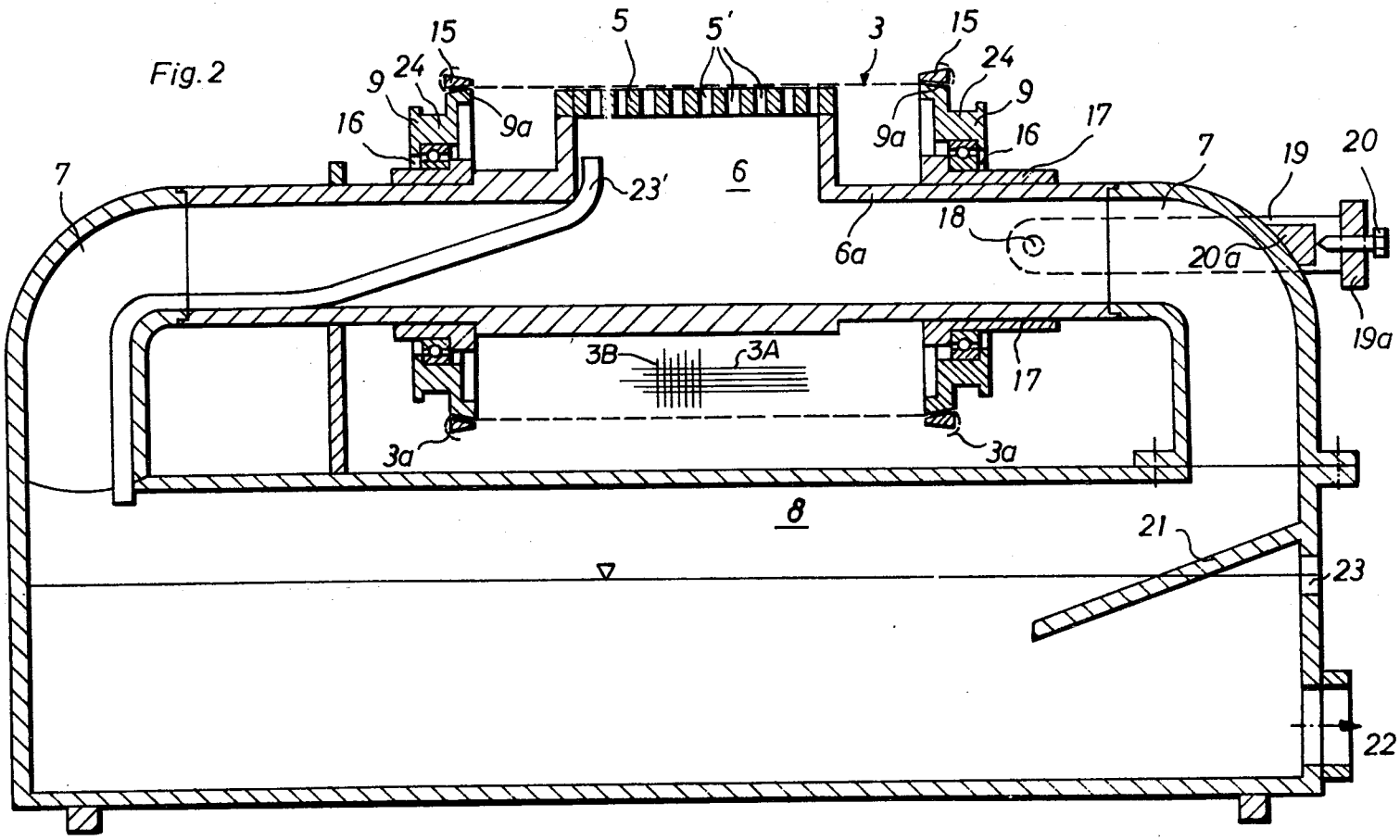
FIG. 2 is a transverse vertical sectional view as seen in the direction of arrows from the line II—II of FIG. 1.

The manner in which the end portions of the shell 3 forming part of the forming cylinder $FC_1$ are separably but fixedly secured to the associated ring-shaped end walls 9 is shown in FIG. 2. The end walls 9 have conical peripheral surfaces 9*a* which cooperate with conical internal surfaces of clamping rings 15 so that the end portions 3*a* of the shell are securely held between the end walls 9 and the respective rings 15. Each end wall 9 has an outer portion 24 which constitutes a pulley for the respective belt 11, and each end wall 9 is mounted on an antifriction bearing 16 so that it can rotate relative to a frame or support 6*a* which may include the respective receptacle 6 and which further carries the return pipes 7. The right-hand bearing 16 of FIG. 2 is mounted on a sleeve 17 which is mounted for axial movement on the support 6*a* and forms part of means for subjecting the shell 3 to axial tensional stresses. The sleeve 17 has outwardly extending coupling pins 18 which are connected with the respective arms of a bifurcated carrier 19 having a crosshead 19*a* for an adjusting screw 20 whose tip bears against an anvil 20*a* secured to the respective return pipe 7. By rotating the screw 20 relative to the crosshead 19*a*, one can change the axial tensional stress upon the shell 3.

The saveall 8 contains at least one deflector or baffle 21 which is located in the path of liquid flowing from the respective return pipe 7 into the interior of the saveall. The purpose of the deflector 21 is to prevent air bubbles which decend with the liquid stream in the right-hand pipe 7 of FIG. 2 from entering the suction inlet 22 of a pump serving to withdraw liquid from the saveall 8. The saveall 8 is provided with at least one overflow opening 23 which insures that the saveall invariably contains a predetermined quantity of liquid. An aerating or pressure equalizing pipe 23' communicates with the space immediately below the underside of the back support 5 and the air-containing space above the liquid level in the saveall 8. The pipe 23' insures that the pressure of air above the liquid level in the saveall 8 equals the air pressure in the region below the discharge ends of ports 5'.

At first, the proposal to use a readily deformable shell without a core which supports the entire internal surface of the shell has met with skepticism by several experts in the field of papermaking. It was believed that, when a papermaking machine is operated at a high speed (e.g., while the web is transported at 1,000 meters per minute), a flexible shell which merely consists of filamentary material and is propped from within solely at the locus where its external surface contacts the web would fail to exhibit requisite dynamic stability to withstand breaking and/or excessive deforming stresses. It was also felt that such a shell would be unable to stand pronounced thermal and/or shearing stresses which are likely to develop in the region of contact with the back support, especially when the back support exerts a substantial force against the internal surface of the shell. In fact, experts in the field of papermaking considered it advisable and necessary to make the shells of sieves or the like from a rigid metallic material even though it is already known, for many years, to use a liquid-lubricated shoe as a means for preventing flexing of the rigid shells of pressing cylinders. Reference may be had to German Auslegeschrift No. 1,461,066 published Dec. 12, 1968. In other words, it was considered necessary to use a rigid shell whose dynamic stability is extremely high and to provide, in addition to the rigid shell, a shoe which supports the rigid shell from within. Presently known attempts to prevent undue flexing of endless wires or felts include the provision of rigid pressing cylinders which are disposed opposite each other and between which the wire or felt passes. The rigid pressing cylinders rotate and extend across the full width of the wire or felt. Reference may be had to German Offenlegungsschrift No. 1,561,674 published Apr. 2, 1970. It will be readily appreciated that such prior art structures are much more expensive, complex and bulkier than a cylinder whose shell is a readily deformable tube made of filamentary material and wherein the shell is supported from within only in the region where its external surface engages the running web.

The forming cylinders of FIGS. 1 and 2 are susceptible of many modifications without departing from the spirit of the invention. For example, each cylinder can be replaced with two or more cylinders which are disposed end-to-end to extend across the full width of the path for the web, or the interior of each of these cylinders may be subdivided into two or more compartments. Also, each back support 5 may be assembled of two or more sections which are disposed end-to-end, or of two or more portions which are located one behind the other, as considered in the circumferential direction of the respective cylinder. The material of the shells may be a wire screen, a felt, a woven textile material, a material consisting of filaments other than those used for the manufacture of textile fabrics and/or a combination of these.

The ports 5' of the back supports 5 can be replaced by or provided in addition to other types of passages, e.g., passages in the form of grooves or recesses in the convex surfaces 5*a*. Proper evacuation of liquid which is expelled from the web is particularly important when the improved cylinders constitute forming cylinders. This is the presently preferred function of the improved cylinders even though the field of their applicability is much larger. If the passages in the surface 5*a* of a back support 5 are recesses or grooves, they preferably extend at an angle to the axis of the respective cylinder. This is desirable because the shells 3 are or can be subjected to pronounced axial stresses whereas the tensional stresses acting circumferentially of the cylinders are relatively low. Therefore, portions of the shells which overlie recesses extending in the axial direction of the respective cylinders would be likely to penetrate into the recesses.

FIG. 3 shows a portion of a second papermaking machine wherein the forming cylinder FC cooperates with an endless wire 25 trained over two guide rolls 27, a tensioning roll 27*a* (which is movable in and counter to the direction indicated by arrow 27A), and a regulating roll 28 which latter is movable in directions indicated by the double-headed arrow 28A. A portion of the wire 25 surrounds a portion of the external surface of the deformable shell 3 of the forming cylinder FC. The convex surface of the stationary rigid back support 5 engages the internal surface of the shell 3 opposite that portion of the external surface of the shell which is surrounded by the wire 25. The slice 2 of the head box 1 directs a jet of paper furnish into the nip of the wire 25 and shell 3 at a level above the back support 5. The passages (e.g., ports) of the back support 5 are not specifically shown; such passages may constitute recesses or grooves in the convex surface of the back support or ports which extend at an angle to the axis of the forming cylinder, either radially of the axis (see the right-hand portion of FIG. 1) or in such a way that their axes cross in space with the cylinder axis (see the left-hand portion of FIG. 1).

At least some of the liquid which is to be expelled from paper furnish supplied by the slice 2 of the head box 1 is squeezed through the interstices of the wire 25 to descend into a receptacle 26 mounted in the space which is surrounded by the wire 25 at a level below the back support 5. The receptacle 26 is mounted in a frame or support including frame members 29. The frame preferably further supports the shafts or trunnions of the rolls 27, 27*a* and 28 in a manner not specifically shown in FIG. 3. The roll 27*a* maintains the wire 25 under requisite tension to thus insure that a relatively high percentage of liquid contents of paper furnish supplied by the slice 2 is expelled through the wire and descends into the receptacle 26. The receptacle 26 communicates with one or more return pipes (not shown) which convey liquid into a saveall (not shown). The frame members 29 extend transversely of the direction of movement of the paper web which is formed on the wire 25 and advances therewith along and beyond the back support 5.

If the shell 3 of FIG. 3 is permeable to liquids, at least some liquid which is squeezed from paper furnish supplied by the slice 2 can flow through the interstices of the shell, through the passages of the back support 5 and into a receptacle 6 (e.g., a suctionchamber) which collects the liquid and conveys it to the save-all, e.g., in a manner as shown in FIG. 2.

The wire 25 cooperates with an endless conveyor 30, e.g., a felt, which is trained over a pickup roll 31 and serves to transport the web toward a further processing station, not shown in FIG. 3. The pickup roll 31 may but need not constitute a section roll, i.e., it may be provided with a permeable or with a solid shell which engages the felt 30 in a region downstream of the back support 5, as considered in the direction of lengthwise movement of the web from the slice 2, thereupon from the 11 o'clock to the 7 o'clock position of the forming cylinder FC, and finally toward the pickup roll 31.

The structure of FIG. 3 constitutes a superior substitute for wire sections of the type wherein the slice injects a jet of paper furnish between two wires one of which is trained over a roll and the other of which overlies the one wire in the region of the roll. Reference may be had to FIG. 6 of Canadian Pat. No. 614,901 to Webster. The cylinder FC of FIG. 3 replaces one of the wires, i.e., it replaces the wire, the tensioning, regulating and guide rolls for such wire, the frame for the rolls and the trough for collection of expelled liquid. It will be readily appreciated that the mass of the forming cylinder FC of FIG. 3 and of associated components is but a fraction of the mass of components if the slice 2 injects paper furnish between two endless wires.

The wear upon the shell 3 of FIG. 3 is practically nil if the expulsion of liquid takes place only through the wire 25. This is due to the fact that friction between the back support 5 and the shell does not develop as long as the nip of the shell and the wire 25 contains free suspension. Thus, as long as the material between the shell 3 and the wire 25 contains free suspension, the tensioned wire 25 bears against a hydraulic cushion which develops along the convex surface of the back support 5 (which is then devoid of passages for evacuation of liquid). Such hydraulic cushion reacts against the surface 5*a* of the back support 5 because the shell 3 is foraminous and is merely subjected to axial tensional stresses.

Figure 4:
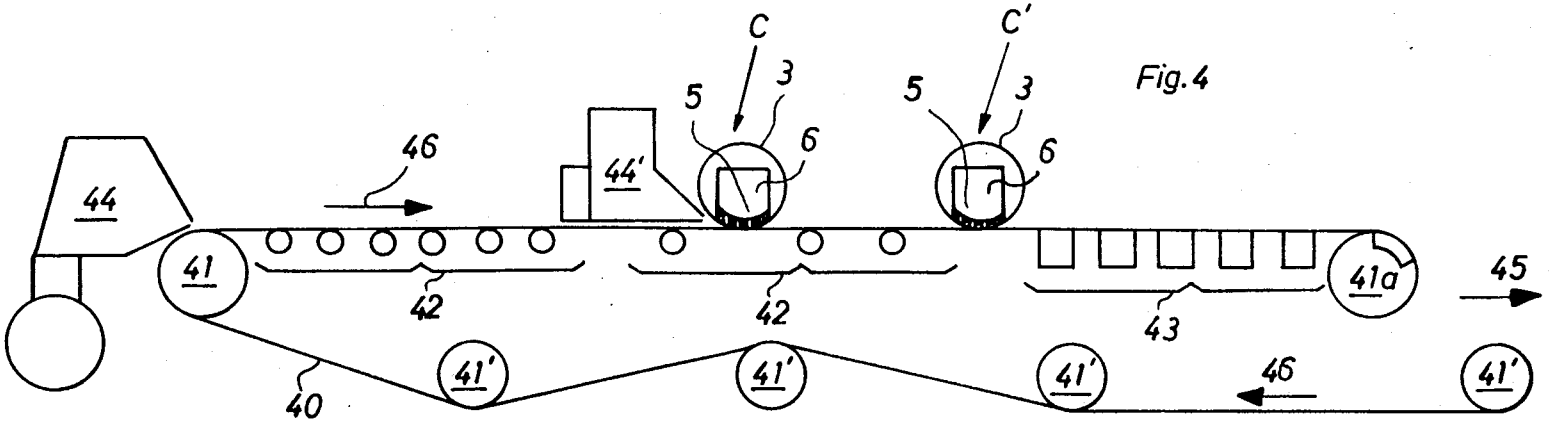
FIG. 4 is a fragmentary schematic side elevational view of a machine which is designed for the making of a multi-layer paper web and has two cylinders which embody the invention and are disposed above the upper reach of a Fourdrinier wire.

FIG. 4 shows a portion of a further papermaking machine having a Fourdrinier wire 40 trained over a breast roll 41, a couch roll 41*a* and several additional rolls 41'. The direction in which the upper reach of the wire 40 travels past a first head box 44, a second head box 44', a first cylinder C and thereupon a second cylinder $C_1$ is indicated by arrow 46. The arrow 45 indicates the direction in which the upper paper web leaves the wire 40 on its way to a further station, e.g., to a battery of presses, not shown. The upper reach of the wire 40 travels above two batteries of table rolls 42 and a series of suction boxes 43. The rolls 42 and boxes 43 evacuate a relatively high percentage of liquid from the paper furnish which is supplied by the slices of the head boxes 44 and 44'.

The cylinders C and $C_1$ are identical with or analogous to the forming cylinders of FIGS. 1 to 3. Their function is to evacuate additional liquid from the web on the upper reach of the wire 40 and/or to press the web against the wire. The first cylinder C is located immediately downstream of the slice of the head box 44' and the second cylinder $C_1$ is located between the table rolls 42 and suction boxes 43. If the cylinders C and $C_1$ are to evacuate liquid, the respective back supports 5 exhibit ports and are located below receptacles 6 in the form of suction chambers. The shells of the cylinders C and $C_1$ are shown at 3.

The cylinders of FIG. 4 replace heavy, bulky and expensive bronze cylinders which are used in conventional Fourdrinier machines. Such conventional cylinders must be cleaned at frequent intervals. Thus, the wire section of the machine shown in FIG. 4 merely comprises the cylinder C and $C_1$, two head boxes, the table rolls 42 and suction boxes 43, and the rolls for the wire 40. This constitutes a substantial simplification of the wire section.

The improved cylinder can be used with equal advantage as a superior substitute for conventional egoutteurs or dandy rolls in connection with a wire or with a felt which carries a layer of paper pulp. An egoutteur which is constructed in accordance with the invention exhibits a highly satisfactory dynamic stability. Moreover, such improved egoutteur can be used as a means for exerting mechanical pressure against the running web as well as a means for simultaneously removing liquid from the web. For example, the second cylinder $C_1$ of FIG. 4 constitutes an egoutteur.

Figure 5:
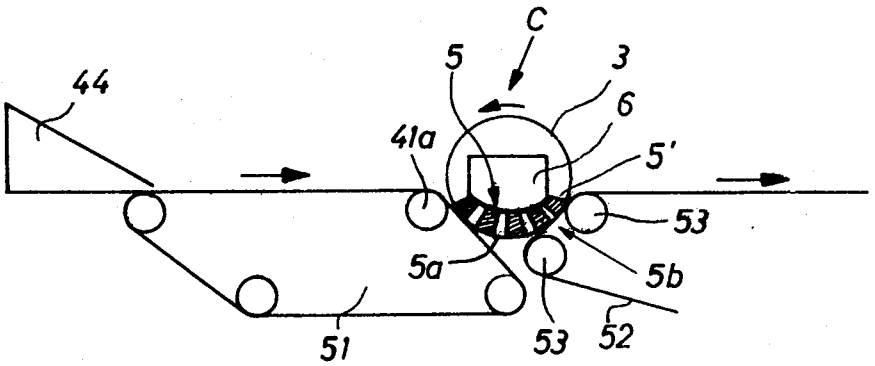
FIG. 5 is a fragmentary side elevational view of a further papermaking machine wherein a cylinder which embodies the invention is used to transfer a web of paper or the like from a wire to a felt.

FIG. 5 illustrates a portion of a further papermaking machine wherein the cylinder C performs the function of a transfer means for a web of paper or the like. The cylinder C is installed between the couch roll 41*a* for a wire 51 and an endless conveyor 52 (e.g., the felt of a dryer) which receives the paper web and transports it further on through the papermaking machine. The back support 5 is formed with ports 5' which extend radially of the cylinder C and attract the web during transport from the couch roll 41*a* toward the felt 52.

The transfer of paper web from the shell 3 of the cylinder C of FIG. 5 can take place by gravity, under the action of centrifugal force, by installing a suction chamber between the rolls 53 for the felt 52 and/or by connecting the right-hand port or ports 5*a* of the back support 5 to a source of compressed gaseous fluid, not shown. Alternatively, the nature of the felt 52 can be selected in such a way that it attracts the paper web with a force which exceeds the adhesion of paper web to the shell 3.

The cylinder C of FIG. 5 performs an important function in a critical region of the paper making machine, namely, where the web must be transferred from a first conveyor (wire 51) onto a second conveyor (felt 52) across a space where it does not find any support by either conveyor. In presently known machines, the transfer of paper webs between successive conveyors often results in breaks. In fact, the cylinder C of FIG. 5 can properly transfer a defective paper web without causing breakage and/or aggravating the defect.

In many instances, the web-contacting portion of the external surface of the shell 3 preferably assumes a shape other than a portion of a circular cylinder. This can be achieved by utilizing a back support having a convex outer surface whose center of curvature is not located on the axis of the cylinder. One form of such back support (denoted by the reference character 105) is shown, somewhat exaggerated, in FIG. 6. The central portion of the convex surface 105*a* of the back support 105 has a relatively small radius of curvature, i.e., a radius of curvature which is smaller than the radius of the associated shell 103 in undeformed condition of the shell. Such deformation of the web-contacting portion of the shell is desirable if the cylinder of the present invention constitutes a forming cylinder because the tip of the slice can be moved nearer to the deepmost portion of the nip of the shell and the associated conveyor, such as the felt 4 of FIG. 1. This enhances the quality of the web. In certain other instances, the radius of curvature of the shell-contacting portion of the back support will equal the radius of the shell, i.e., the center of curvature of the shell-contacting portion of the back support will be located on the axis of the cylinder (see FIGS. 1 to 5). Also, the back support may be formed with a flat outer surface.

Since the shell 3 is readily deformable, it can follow the outline of the outer surface of the back support 5 or 105 in response to the application of relatively small deforming stresses. For example, suction in the receptacle 6 can suffice to insure that the internal surface of the shell lies flush against the surface 5*a* or 105*a* of the respective back support. Alternatively, the back support will exert a relatively small deforming stress in order to insure full contact between its surface 5*a* or 105*a* and the adjacent portion of internal surface of the shell.

In certain instances, the curvature of the surface 5*a* or 105*a* will be selected with a view to conform to the progress of expulsion of liquid and to thus reduce shearing stresses upon the shell 3. Pronounced curvature of the surface 5*a* or 105*a* is further desirable when the improved cylinder is used in a manner as shown in FIG. 5, i.e., for transfer of a web from a first conveyor (wire 51) onto a second conveyor (felt 52). The web is more likely to offer less resistance to transfer from the external surface of the shell 3 to the adjacent portion of the felt 52 if the curvature of the surface 5*a* is more pronounced in the region 5*b* where the web leaves the shell 3 to be taken over by the felt. Moreover, pronounced curvature of the surface 5*a* in the region 5*b* is desirable on the additional ground that the thus formed lobe of the shell 3 exerts a substantial pressure against those increments of the web which are about to reach the felt 52. This renders it possible to insure a satisfactory transfer of the web without resorting to a couch roll between the rolls 53 of FIG. 5.

It is clear that the improved cylinder can be used with equal advantage for transport of fibers other than those which are utilized for the making of paper webs. For example, the cylinder can be used as a means for forming, guiding and/or transporting webs which consist of or include filaments made of synthetic plastic material.

Without further analysis, the foregoing will so fully reveal the gist of the present invention that others can, by applying current knowledge, readily adapt if for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

What is claimed is:

1. In a machine for forming, guiding and/or transporting elongated webs of fibrous material which move along a predetermined path, particularly in the wire section of a papermaking machine, a combination comprising a hollow cylinder including a deformable tubular shell adjacent one side and extending transversely of said path, said shell being permeable to fluids, consisting of intersecting filaments which define a plurality of interstices, and having first and second end portions, an external surface including a web-contacting portion and an internal surface, and rigid rotary walls connected with said end portions of said shell; and a rigid back support located in the interior of said cylinder and having a back support surface contacting said internal surface of said shell substantially only opposite said web-contacting portion of said external surface.

2. A combination as defined in claim 1, wherein said shell-contacting surface of the back support defines fluid receiving passages.

3. A combination as defined in claim 2, wherein said passages include ports extending through said back support, and further comprising a receptacle adjacent said back support opposite said shell-contacting surface and positioned to receive the fluid passing through said ports.

4. A combination as defined in claim 3, wherein said receptacle is a suction chamber.

5. A combination as defined in claim 2, wherein said passages include ports extending through said back support and being inclined with respect to the axis of said cylinder.

6. A combination as defined in claim 5, wherein said ports extend substantially radially of said cylinder.

7. A combination as defined in claim 5, wherein the axes of said ports cross in space with the axis of said cylinder.

8. A combination as defined in claim 1, wherein said back support has a curved shell-contacting surface with a center of curvature spaced apart from the axis of said cylinder.

9. A combination as defined in claim 1, further comprising means for rotating said shell through the medium of at least one of said end walls.

10. A combination as defined in claim 9, wherein said rotating means comprises an endless flexible element which is trained over and rotates said one end wall.

11. A combination as defined in claim 1, wherein said filaments include a first group of filaments extending in substantial parallelism with the axis of said cylinder and a second group of filaments extending substantially circumferentially of said cylinder.

12. A combination as defined in claim 1, wherein said cylinder is the forming cylinder of a papermaking machine.

13. A combination as defined in claim 1, wherein said cylinder is the dewatering cylinder of a papermaking machine.

14. A combination as defined in claim 1, wherein said cylinder is the dandy roll of a papermaking machine.

15. A combination as defined in claim 1, wherein said cylinder forms part of the wire section in a papermaking machine and further comprising a conveyor arranged to receive the web from said portion of the external surface of said shell.

16. A combination as defined in claim 15, wherein said conveyor is an endless felt.

17. In a machine for forming, guiding and/or transporting elongated webs of fibrous material which move along a predetermined path, particularly in the wire section of a papermaking machine, a combination comprising a hollow cylinder including a deformable tubular shell adjacent one side and extending transversely of said path, said shell consisting of intersecting filaments which define a plurality of interstices and having first and second end portions, an external surface including a web-contacting portion and an internal surface, and rigid rotary walls connected with said end portions of said shell; a rigid back support located in the interior of said cylinder and engaging said internal surface of said shell opposite said web-contacting portion of said external surface; and means for moving at least one of said end walls axially with respect to the other end wall to thereby change the axial tensional stress upon said shell.

18. A combination as defined in claim 17, wherein said filaments include a first group of filaments extending in substantial parallelism with the axis of said cylinder and a second group of filaments extending substantially circumferentially of said cylinder.

* * * * *